United States Patent [19]

Walsh

[11] 4,179,342

[45] Dec. 18, 1979

[54] COATING SYSTEM METHOD FOR COLORING ALUMINUM

[75] Inventor: Adam J. Walsh, Barrington, R.I.

[73] Assignee: Reynolds Metals Company, Richmond, Va.

[21] Appl. No.: 22

[22] Filed: Jan. 2, 1979

Related U.S. Application Data

[63] Continuation-in-part of Ser. No. 920,053, Jun. 28, 1978, abandoned.

[51] Int. Cl.[2] ..... C25D 11/22

[52] U.S. Cl. ..... 204/35 N; 204/38 A

[58] Field of Search ..... 204/35 N, 38 A, 58

[56] References Cited

U.S. PATENT DOCUMENTS

| | | | |
|---|---|---|---|
| 3,382,160 | 5/1968 | Asada | 204/35 N |
| 3,524,799 | 8/1970 | Dale | 204/58 |
| 3,669,856 | 6/1972 | Gedde | 204/58 |
| 3,704,210 | 11/1972 | Patrie | 204/35 N |
| 3,769,180 | 10/1973 | Gedde | 204/35 N |
| 3,849,263 | 11/1974 | Gedde | 204/35 N |
| 4,014,758 | 3/1977 | Kawai | 204/28 |

*Primary Examiner*—John H. Mack
*Assistant Examiner*—William Leader
*Attorney, Agent, or Firm*—Glenn, Lyne, Girard, Clark & McDonald

[57] ABSTRACT

A novel process is disclosed for the production of colored coatings on articles of aluminum or aluminum alloys. The process involves first forming a hard, dense anodic coating of between about 0.2 to about 1.1 mils on the aluminum or aluminum base alloys by anodizing the aluminum in an acidic aqueous electrolyte comprising sulfuric acid, a polyhydric alcohol of from 3 to 6 carbon atoms and an organic carboxylic acid containing at least one reactive group in the alpha-position coloring the coating by applying alternating current to an electrode system comprising the coating and a counterelectrode immersed in an acidic aqueous bath containing a metal salt while modulating the voltage externally of said electrode system so as to apply voltage with controlled assymmetry to said electrodes.

17 Claims, No Drawings

COATING SYSTEM METHOD FOR COLORING ALUMINUM

This application is a continuation-in-part of U.S. Pat. application Ser. No. 920,053 filed June 28, 1978 now abandoned.

BACKGROUND OF THE INVENTION

1. Field of the Invention

The present invention relates to a process for the production of colored protective coatings on articles of aluminum or aluminum alloys which have been previously anodized in a special way in order to obtain products which are particularly suitable for use in architectural applications.

2. Description of the Prior Art

Much time and attention devoted in the prior art to the production of aluminum articles which are decorative and resistant to abrasion under atmospheric influence. Early processes have included chemical coloring of aluminum articles which had previously been anodically anodized by the treatment of the same with dyes, such as aniline dyes. As the art is well aware, the thus resulting articles have poor resistance towards atmospheric influence. Other developments have included anodic oxidation of aluminum articles, followed by submersion in chemicals which penetrate into the pores of the oxide layer, so that when the thus treated aluminum article is placed in aqueous solutions of salts which also penetrate into the pores, combination with the first used chemical is possible. These processes have not proven practical for a wide variety of reasons.

It is also known in the prior art to simultaneously anodize and color aluminum articles. However, the art is aware that processes of this type result in only a limited selection of colors and that the processes are expensive and difficult to carry out and very rigid requirements are made for the working and heat treatment of the aluminum articles as the metallic structure therein is of the utmost importance for the result obtained. These simultaneous processes also demand the use of large currents and high voltages and long times and are thus relatively expensive.

U.S. Pat. Nos. 3,669,856; 3,769,180 and 3,849,263 represent recent developments in the field of coloring aluminum or aluminum alloys. These patents are, in general, directed towards the coloring of anodized aluminum by immersing said article in a bath containing a salt of a particular metal and passing an alternating current between the previously anodized article and a counterelectrode.

Although the process of these patents represent a significant improvement in the field of coloring aluminum, nevertheless, no details are given as to how the previously formed anodic coating is formed on the aluminum and, in fact, at least the implication is present that conventional anodizing techniques are used.

It is also well known in the art of anodizing aluminum that two separate and distinct types of an oxide layer can be obtained which are generally referred to in the art as a hard coat or a soft coat. The conventional anodizing techniques utilized in the art result in the production of a so-called soft coat. There are processes known in the art for the production of hard, dense anodic coatings, but the techniques employed in the art for the subsequent dyeing of these hard, dense coatings have involved the conventional immersion with a suitable dye, as opposed to an electrolytic coloring process. The reason for this might be due to the fact that the techniques for the production of hard anodized coatings result in the production of anodic layers which are significantly colored and can therefore only be dyed to darker and muddier colors by the use of organic or inorganic dyestuffs. The art is also aware that the thicker the anodic layer is formed that the darker the anodic layer will be and, in general, those processes which produced hard anodic layers had as one of their criticalities the production of a thick layer. These thick layers of anodic film are totally unsuitable for the novel process of this invention.

As has heretofore been stated, there are processes known in the art for the production of a hard anodized layer. Of such known processes, those which have the anodizing bath at low temperature (around 32° F.) or intermediate temperature (around 45° F.) are unsuited for the use of the novel process of this invention for several reasons. In the first place, these processes are expensive and require substantial energy in order to operate. Further, these processes produce an anodized layer which is relatively thick (customarily 1.5 mil or heavier) in order to obtain high wear resistance, and which is a darkish, muddied color thereby rendering it unsuitable for use where light, unmuddied colors are desired. On the other hand, the known hard coat process which operates at room temperature (with the anodizing bath at about 70° F.) uses a higher current density than that of the present invention, resulting in the production of an anodized layer unsuitable for use in producing a wide range of colors.

U.S. Pat. No. 3,524,799 is directed towards a room temperature process for anodizing aluminum in order to produce hard, dense anodic coatings and the novel process of the present invention utilizes as one step thereof a modification of the process disclosed by this patentee.

The specification and claims of this patent are directed to the formation of hard, dense anodic coatings on aluminum or aluminum alloys by anodizing the aluminum in an aqueous electrolyte containing a mineral acid, such as sulfuric acid, a polyhydric alcohol of 3 to 6 carbon atoms, an organic carboxylic acid containing at least one reactive group in the alpha-position to the carboxylic acid group, such as lactic acid or glycine, and an alkali salt of a titanic acid complex of a hydroxyaliphatic carboxylic acid containing from 2 to 8 carbon atoms, such as, for example, titanium dilactate ammonium salt.

We have now discovered that the use of such anodizing techniques without the alkali salt of a titanic acid complex provide extremely dense and hard anodic coatings optimally suited to architectural applications and that such anodized layers when colored using the techniques described in U.S. Pat. No. 3,669,856 provide aluminum and aluminum alloy surface of very pleasing, architecturally pure colors of exceptional uniformity. Additionally, the use of the combination of these prior art techniques apparently provides exceptional throwing power in the coloring operation. Throwing power is a term of art defining the ability of a coloring bath and process to provide color uniformly to all surfaces of the surface of a workpiece undergoing coloring. Thus, a process and bath which demonstrates high throwing power provides uniform color to small creases, cracks, nooks, detents, etc., as well as the larger uniform surfaces of an aluminum or aluminum alloy workpiece being colored. High throwing power also permits the introduction into the coloring bath of a mix of workpieces in terms of their alloy composition and overall physical configuration to obtain uniform color of all such workpieces. In prior art coloring techniques it was often difficult, if not impossible to obtain uniform coloring of workpieces of different alloys or shape in a single coloring bath at the same time. Furthermore, as is well recognized by the skilled artisan in the aluminum coloring field spacing of the various workpieces in the coloring bath was a critical factor in successfully uniformly coloring aluminum extrusions, particularly for architectural purposes. Such spacing restraints often required leaving sufficient distances between the undivided pieces being colored that substantial portions of the working volume of a given coloring tank were left empty during a coloring operation resulting in very inefficient use of coloring tank capacity. The exceptional throwing power of the technique of the instant invention permits minimal spacing of the workpieces in the coloring bath and thus optimum usage of the coloring capacity of a coloring tank. This results not only in a more optimum efficiency in terms of use of tank capacity, but reduces substantially the chemical and power requirements of the electrolytic coloring process.

SUMMARY OF THE INVENTION

According to the present invention, a novel process is disclosed for the production of colored coatings on articles of aluminum or aluminum alloys which are particularly adapted to be employed for architectural uses which involves first forming a hard, dense anodic coating on aluminum and aluminum base alloys by anodizing the aluminum in a specific electrolyte comprising sulfuric acid, a polyhydric alcohol of 3 to 6 carbon atoms and an organic carboxylic acid containing at least one reactive group in the alpha-position in order to obtain a material having a film thickness of between about 0.2 to about 1.1 mils and thereafter electrolytically coloring said anodized aluminum by passing alternating current between said anodized aluminum and a counterelectrode immersed in an acidic aqueous bath and a metal salt, such as tin, while modulating as to amplitude or frequency the alternating voltage externally of said electrode system so as to apply voltage of controlled assymetry to said electrodes.

DETAILED DESCRIPTION

In order to obtain the architecturally acceptable and desirable hard anodic coatings of pure clean color as described above, it is absolutely critical that the anodic layer be between about 0.2 and about 1.1 mils in thickness, as opposed to the 1–5 mils set forth at column 3, line 26 of said U.S. Pat. No. 3,524,799.

As already pointed out, the electrolyte used to anodize the aluminum must be of the type described in U.S. Pat. No. 3,524,799 without any alkali salt of titanic acid complex.

Apparently, as described in U.S. Pat. No. 3,524,799, the combination is an anodizing bath of a polyhydric alcohol containing from 3 to 6 carbon atoms, and an organic carboxylic acid containing a reactive group in alpha-position to the carboxylic acid group will react with the hot reaction products formed during anodizing with or adjacent to the surface of the pore base, and thereby suppress the attack or dissolution of the forming oxide film by these products.

The mineral acid component of the electrolyte is sulfuric acid. The anodizing bath concentration of sulfuric acid is generally maintained between about 12% and about 20% by weight, preferably about 15%.

Polyhydric alcohols containing from 3 to 6 carbon atoms which may be employed in the practice of the invention, singly or in admixture, include glycerol, butane-diol-1,4, pentanediol-1,5, mannitol and sorbitol. The total amount of polyhydric alcohol employed ranges from about 1% to about 4% by volume of the anodizing electrolyte. The preferred polyhydric alcohol is glycerol.

The organic carboxylic acids containing a reactive group in alpha-position to the carboxylic acid group include acids in which the reactive group is hydroxy, amino, keto, or carboxyl. Examples of such acids include glycolic (hydroxyacetic), lactic (hydroxypropionic), malic (hydroxysuccinic), oxalic, pyruvic, and aminoacetic acids. Acyclic carboxylic acids such as latic, malic, and amino-acetic (glycine) acids are preferred. A mixture of two or more of these acids may be employed in combination with the mineral acid and the polyhydric alcohol. The amount of carboxylic acid included in the electrolyte is preferably between about 1% and about 4% by volume of the bath.

Glycolic acid is specifically preferred as the carboxylic acid.

In order to achieve the results described above, the temperature at which anodizing is carried out must range from about 65° to about 85° F. with room temperature condition, i.e., 68°–75° F. being preferred.

In order to achieve the exceptionally hard and readily colored anodic coatings, it is also necessary that the current density which is used in the anodizing operation should be in the range of from about 24 to about 36 amperes/sq. ft.

The time required to achieve the desired film thickness of between about 0.2 and 1.1 mils will vary with the other parameters of temperature, current density, chemical composition of the bath, etc., but generally anodizing times on the order of from about 8 to about 30 minutes produce acceptable results.

Following the special anodizing treatment, above-described, the aluminum article is thereafter colored electrolytically by passing alternating current between said article and a counterelectrode in an aqueous acidic solution containing a water soluble metal salt.

The particular manner of electrolytically coloring the anodized aluminum in accordance with the novel process of this invention is set forth in U.S. Pat. No. 3,669,856, the disclosure of which is herein incorporated by reference. It has been found that if the aluminum is anodized in the manner above-described and thereafter electrolytically colored in accordance with the teachings of U.S. Pat. No. 3,669,856 many significant advantages will be obtained as opposed to the use of conventional anodizing techniques. In the first place, the article which is obtained has a hard coating which makes it particularly adapted to be used in architectural applications. Additionally, the process of this invention permits the simultaneous electrolytic coloring of articles of varying sizes and shapes. This has been difficult if not impossible, to achieve in prior art processes due to the fact that uneven color was obtained when articles of different sizes and shapes were simultaneously electrolytically colored. Another advantage of the novel process of this invention resides in the fact that the aluminum article to be colored need only have electric contact at one edge thereof, as opposed to both edges. This results in a significant manpower savings. Another advantage of the novel process of this invention resides in the fact that it is possible to correct for too dark a color electrolytically which has heretofore been impossible with processes utilizing dyes or with processes involving simultaneous anodizing and coloring. According to this technique, after application of an excess of color the polarity of the coloring system is reversed and color can be subtracted from the anodized layer.

As has heretofore been stated, the electrolytic coloring process is carried out by passing an alternating current between the anodized article of aluminum or aluminum alloy which has been carried out in the manner above-described, and a counterelectrode immersed in an acid aqueous bath containing metal salts having coloring cations, wherein the colored tones of the coatings can be controlled in a simple manner by modulating the shape of the curve of the applied alternating voltage in such a manner that during the coloring process the alternating voltage will provide a suitable ratio between the two current directions for an advantageous transport of material and course of reaction with regard to said anodized aluminum article. The alternating voltage supplied is modulated as regarding its amplitude and/or frequency so as to make asymmetrical, thereby to control the color tone of the aluminum article. As is known in the art, the modulation of the alternating voltage can be carried out in several ways, such as simultaneously supplying two or more different alternating voltages or a superimposed direct voltage or by generating an alternating voltage having the desired frequency and curve shape.

The material for the counterelectrodes can be stainless steel, titanium, copper, nickel, but preferably tin because they lead to advantageously low energy consumption.

The strength of the alternating voltage in the modulation of the amplitude and/or frequency thereof according to the present process is from 5–50 volts, depending upon the composition of the electrolyte and the properties of the oxide layer previously formed. Preferably there is used a current density of from 0.1 to 0.5 A/dm$^2$, dependent on the electrolyte employed and a low treatment period of from 1 to 10 minutes.

As is known in the art, various soluble metallic salts can be employed. The preferred salts are those of tin, although salts of nickel, cobalt, copper, silicomolybdic acid and silicotungstic acid can also be employed. The electrolytic coloring bath also contains a strong acid which is desirably either sulfuric or hydrochloric.

As is well known in the art, the metallic salts, e.g., sulfates, chlorides, acetates, etc. desired to provide the particular color can be utilized at a concentration of from 0.5 to 20% by weight, preferably about 2% by weight based on the electrolyte. The pH of the electrolyte may vary considerably within the acid range, but pHs of about 1.5 have been found to be useful.

A particularly preferred embodiment resides in having present in the electrolyte a certain amount of aluminum. In this connection, the aluminum can be provided by the addition of suitable aluminum compounds, such as aluminum sulfate or a certain part of a previously used electrolytic bath can also be used. The amount of aluminum which is present in the electrolyte can range from 0–12 grams/liter, and more desirably, from 4–8 grams/liter.

As has heretofore been pointed out, the novel process of this invention is applicable to color articles made from aluminum, as well as from aluminum base alloys of all kinds.

It is particularly preferred initially to supply a symmetrical alternating current and then add asymmetrical alternating current.

In addition, the coloring takes place faster, more efficiently if the alternating current is regulated relatively slowly of the order of a few seconds from 0 to the voltage which is desired for the coloring. This relates to both the starting up of the coloring and to a latter supply of another alternating voltage than the one initially used.

Further improvement in the throwing power of the coloring solution of the instant invention can be achieved by incorporation of material which serves as a complexing or sequestering agent for the coloring metal ion. Although the mechanism for this further improvement is not fully understood, it has been found that the addition of small amounts on the order of $5\times10^{-5}$ to $5\times10^{-3}$ grams/liter of, for example a combination of $\beta$-naphthol and gelatin in a ratio of about 2:1 naphthol to gelatin or 4,4 di(dimethyl-amino)diphenyl methane to the coloring bath provides even more improved coloring baths.

The following examples will illustrate the novel process of this invention.

EXAMPLE 1

An aluminum article was anodized in accordance with normal anodizing techniques utilizing a current density of 24 amperes/sq. ft. and an electrolytic bath comprising 20 weight percent surfuric acid, and 8 grams/liter of oxalic acid. The temperature utilized ranged from 18°–21° C., and the resulting aluminum article had an anodized layer of 25 microns. The results product was not suitable for coloring due to the fact that it was darkish in color.

As is obvious from the above experiment, the anodizing solution used was other than that of the instant invention.

EXAMPLE 2

An aluminum article was anodized using a solution comprising 18 weight percent sulfuric acid, 1% glycolic acid and 1% glycerol. The anodizing was carried out at a current density of 36 amperes/sq. ft. at a temperature of about 19.5° C. After 13 minutes an anodized layer of approximately 0.83 mils was obtained.

The anodized aluminum article was then electrolytically colored by immersing the same into a bath comprising 25 grams/liter sulfuric acid, 22 grams/liter sulfonic acid, 25 grams/liter tin sulfate, 5 grams/liter aluminum sulfate, 0.2 grams/liter of $\beta$-naphthol and 0.4 grams of gelatin per liter. The electrolytic coloring was carried out by applying alternating current through the electrolyte at a voltage of 8 volts for three minutes. Three minutes of half-wave alternating current was then applied.

An aluminum article having a blackish color was obtained.

EXAMPLE 3

An aluminum article was anodized utilizing the electrolyte solution of Example 2 at a current density of 40 amperes/sq. ft. at a temperature of 20° C.

The anodized article which was obtained was thereafter electrolytically colored in accordance with the techniques of U.S. Pat. No. 3,669,856. This resulted in an article having poor color.

EXAMPLE 4

An aluminum article was anodized utilizing the anodizing solution set forth in Example 2 at a temperature of 20° C. and at a current density of 48 amperes/sq. ft. The anodizing was carried out until an anodized layer was obtained which had a thickness of about 1.65 mils. Subsequent color anodizing of this material in accordance with the techniques of this invention resulted in spalling on the anodic film.

It is apparent that the thickness of the anodized layer obtained during the anodizing step was simply too great to produce the satisfactory product desired by the techniques of this invention.

EXAMPLE 5

An aluminum article was anodized utilizing the electrolyte solution of Example 2 at a temperature of 21° C. until an anodized layer having a thickness of about 0.8 mils was obtained.

This material was then electrolytically colored utilizing the techniques of U.S. Pat. No. 3,669,856 and the color solution of Example 2. Alternating current was applied for 1 ½ minutes and thereafter a half-wave alternating current was applied for a half-minute. The resulting material was colored satisfactorily and was capable for use as an architectural material.

EXAMPLE 6

An aluminum article was anodized using the electrolytic solution of Example 2 at a temperature of 20° C. for six minutes in order to obtain an article which had a thickness of approximately 0.4 mils. This material was then electrolytically colored utilizing the solution of Example 2 by passing normal AC current between the aluminum article and a counterelectrode for two minutes, thereafter an alternating current having a minus half-wave which was asymmetrical was applied for one minute.

A very acceptable black color was obtained. It is to be noted that normal anodizing techniques could not have obtained color in an anodic film this thin.

EXAMPLE 7

An aluminum article was anodized utilizing the solution of Example 2 at a temperature of 20° C., a current density of 36 amperes/sq. ft. in order to obtain a material which had a thickness of 1.1 mils. The material was thereafter color anodized utilizing the tin solution set forth in Example 2 and the technique of U.S. Pat. No. 3,669,856. Alternating current was applied for 1 ½ minutes followed by half-wave at one minute. A perfectly acceptable colored article was obtained.

EXAMPLE 8

The process of Example 5 is repeated with the exception that after the product was run to a bronze color, it was immersed in an oxidizing acid, preferably 20–30 volume % nitric acid at room temperature, which resulted in a uniform champagne color. This color is virtually impossible to produce in a uniform manner by any other known process.

The desirable hardness of coatings made in accordance with the invention is evidenced by high coating density. For example, four samples were prepared using 6063 alloy and the process of Example 5 except that the current times in the coloring bath were varied as follows, with the following results:

| Sample | Color | Alternating Current -Minutes | ½ Wave Current -Minutes | Coating Thickness -Mil | Coating Weight -Gm/in$^2$ |
|---|---|---|---|---|---|
| A | Light Bronze | 2 | 0 | .84 | 68 |
| B | Medium Bronze | 3 | 0 | .75 | 70 |
| C | Dark Bronze | 3 | 1½ | .83 | 90 |
| D | Black | 3 | 4 | .86 | 138 |

It will be readily understood that the description herein is for the purpose of illustration and that the scope of the invention is limited only by the appended claims.

What is claimed is:

1. In a process for the production of colored protective coatings on previously anodized articles of aluminum or aluminum alloys wherein an alternating current is passed between an electrode system comprising said previously anodized aluminum article and a counterelectrode immersed in an acidic aqueous bath containing salts of metals capable of coloring the anodized layer and wherein voltage with controlled asymmetry is applied to the electrodes so as to control the color tone of the aluminum article by modulating the voltage externally of said electrode system, the improvement which comprises, anodizing said aluminum article in aqueous acid electrolyte comprising from about 12 to about 24 weight percent sulfuric acid and from about 1 to about 4 volume percent of a polyhydric alcohol of from 3 to 6 carbon atoms and from about 1 to about 4 volume percent of an organic carboxylic acid containing at least one reactive group in the alpha-position wherein said reactive group is a hydroxy, amino, keto or carboxyl group, and carrying out the anodizing at a temperature of from 65°–85° F. at a current density of 24–36 amperes/sq. ft. so as to obtain an anodized layer from 0.2–1.1 mils.

2. The process of claim 1 wherein said anodizing is performed at a temperature of between about 68° and 75° F.

3. The process of claim 1 wherein the organic carboxylic acid is either glycolic acid or lactic acid.

4. The process of claim 1 wherein the polyhydric alcohol is glycerol.

5. The process of claim 1 wherein the metal salt capable of coloring is tin sulfate.

6. The process of claim 1 wherein the metal salt capable of coloring is nickel sulfate.

7. The process of claim 1 wherein the metal salt capable of coloring is copper sulfate.

8. The process of claim 1 wherein the metal salt capable of coloring is cobalt sulfate.

9. The process of claim 1 wherein 4–8 grams/liter of aluminum is present in the coloring bath.

10. The process of claim 1 wherein initially a symmetrically alternating voltage is passed followed by the asymmetrically alternating voltage.

11. The process of claim 1 wherein the metal salt capable of coloring is a soluble tin salt.

12. The process of claim 10 wherein the metal salt capable of coloring is a soluble nickel salt.

13. The process of claim 10 wherein the metal salt capable of coloring is a soluble copper salt.

14. The process of claim 1 including the additional further step of reversing the polarity of the coloring bath and subtracting color from the anodized layer.

15. The process of claim 1 wherein said aqueous acid coloring bath also includes a sequestering agent for the metal salts.

16. The process of claim 15 wherein said sequestering agent comprises a mixture of $\beta$-naphthol and gelatin or 4,4 di(dimethylamino) diphenyl methane.

17. The process of claim 16 wherein the sequestering agent is used at a concentration of between about $5\times10^{-5}$ to about $5\times10^{-3}$ grams/liter of bath.

* * * * *